US007093474B2

(12) United States Patent
Hiramoto et al.

(10) Patent No.: US 7,093,474 B2
(45) Date of Patent: Aug. 22, 2006

(54) EXTRUSION DIE FOR MANUFACTURING TUBE WITH SMALL HOLLOW PORTIONS, MANDREL USED FOR SAID EXTRUSION DIE, AND MULTI-HOLLOWED TUBE MANU-FACTURED BY USING SAID EXTRUSION DIE

(75) Inventors: Kimihisa Hiramoto, Tochigi (JP); Hideyo Yamasaki, Tochigi (JP); Fumio Shimizu, Tochigi (JP)

(73) Assignee: Showa Denko K.K., Tokyo (JP)

( * ) Notice: Subject to any disclaimer, the term of this patent is extended or adjusted under 35 U.S.C. 154(b) by 206 days.

(21) Appl. No.: 10/491,270

(22) PCT Filed: Oct. 22, 2002

(86) PCT No.: PCT/JP02/10955

§ 371 (c)(1),
(2), (4) Date: Mar. 31, 2004

(87) PCT Pub. No.: WO03/035293

PCT Pub. Date: May 1, 2003

(65) Prior Publication Data

US 2004/0244457 A1 Dec. 9, 2004

Related U.S. Application Data

(60) Provisional application No. 60/341,247, filed on Dec. 20, 2001.

(30) Foreign Application Priority Data

Oct. 23, 2001 (JP) ..... 2001-325592

(51) Int. Cl.
*B21C 25/04* (2006.01)

(52) U.S. Cl. ..... 72/269; 72/264; 72/467

(58) Field of Classification Search ..... 72/253.1, 72/260, 264, 269, 467; 29/890.045, 890.046, 29/890.052; 138/138, 139; 165/172, 177, 165/182, 906

See application file for complete search history.

(56) References Cited

U.S. PATENT DOCUMENTS 3,486,489 A * 12/1969 Huggins ..... 123/41.33
3,527,079 A * 9/1970 Braeuninger ..... 72/269
5,131,253 A * 7/1992 Hopkins ..... 72/269
6,880,627 B1 * 4/2005 Sanada et al. ..... 165/152

FOREIGN PATENT DOCUMENTS

EP 0596507 5/1994
JP 58-110119 6/1983

(Continued)

*Primary Examiner*—Ed Tolan
(74) *Attorney, Agent, or Firm*—Oblon, Spivak, McClelland, Maier & Neustadt, P.C.

(57) ABSTRACT

An extrusion die for manufacturing a tube with a plurality of small hollow portions arranged in a width direction of the tube, includes a female die for defining an outer periphery of the tube and a mandrel combined with the female die. The mandrel includes a body portion and a comb-shaped portion protruded from the body portion, the combe-shaped portion including a plurality of columnar portions desposed in a width direction of the comb-shaped portion at certain intervals. An outer periphery of a tip end portion of each of the plurality of columnar portion constitutes a bearing portion for defining an inner periphery of each of the plurality of small hollow portions of the tube. Each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space. The at least one of the outside surfaces extending from a basal end portion of each of the plurality of columnar portions to the inwardly dented portion is formed into an inclined or curved surface for leading extrusion material to the inwardly dented portion. The at least one of the outside surfaces extending from the dented portion to the bearing portion is formed into an inwardly curved surface.

12 Claims, 11 Drawing Sheets

FOREIGN PATENT DOCUMENTS

| | | |
|---|---|---|
| JP | 1-99716 | 4/1989 |
| JP | 1-273610 | * 11/1989 |
| JP | 1-284423 | * 11/1989 |
| JP | 2002-018512 | 1/2002 |

* cited by examiner

EXTRUSION DIE FOR MANUFACTURING TUBE WITH SMALL HOLLOW PORTIONS, MANDREL USED FOR SAID EXTRUSION DIE, AND MULTI-HOLLOWED TUBE MANU-FACTURED BY USING SAID EXTRUSION DIE

This application is a 35 USC 371 of PCT/JP02/10955 filed Nov. 22, 2002 and claims priority to Japanese Patent Application No. 2001-325592 filed on Oct. 23, 2001 and U.S. Provisional Application No. 60/341,247 filed on Dec. 20, 2001 the disclosure of which is incorporated by reference in its entirety.

Cross Reference to Related Applications

This application is an application filed under 35 U.S.C. §111(a) claiming the benefit pursuant to 35 U.S.C. §119(e)(1) of the filing date of Provisional Application No. 60/341,247 filed on Dec. 20, 2001 pursuant to 35 U.S.C. §111(b).

TECHNICAL FIELD

The present invention relates to an extrusion die for manufacturing a tube with a plurality of small hollow portions to be used for an aluminum flat heat exchanging tube for heat exchangers. It also relates to a mandrel used for the extrusion die, a multi-hollowed tube manufactured by using the extrusion die, a method for manufacturing a heat exchanging tube, a heat exchanger and a method for manufacturing the heat exchanger.

BACKGROUND ART

In heat exchangers such as aluminum condensers for automobiles, as generally shown in FIG. 8, a flat heat exchanging tube 200, which is called as a harmonica tube having a number of small hollow portions 202 arranged in a width direction thereof via partitioning walls 201, is used.

In manufacturing such a multi-hollowed tube by extrusion forming, an extrusion die having a female die for defining an outer periphery of the tube and a mandrel 300, as shown in FIG. 11, to be combined with the female die, is used.

The mandrel 300 has a body 301 and a comb-shaped portion protruded from the body 301 having a plurality of columnar portions 302 and arranged in the width direction of the comb-shaped portion at certain intervals. The outer periphery of the tip end portion of each columnar portion 302 constitutes a bearing portion 303 for defining an inner periphery of each of plural hollow portions arranged in the width direction of the tube.

This mandrel 300 is combined with the female die such that the bearing portions 303 of the comb-shaped portion are disposed in the opening of the female die to constitute an extrusion die. In manufacturing the extruded tube, extrusion material such as an aluminum billet loaded in a container is pressurized by a stem and the like from the rear side of the mandrel 300 to forcibly introduce the extrusion material into a gap between the female die and the columnar portions 302 and a gap between adjacent columnar portions 302, to thereby extrude the material continuously into the extrusion tube.

Now, as a heat exchanger is required to be small in size and high in performance, a multi-hollowed extrusion tube 200 for use in heat exchangers is also required to reduce the thickness of the partitioning wall 201 and the width of each hollow portion 202. In order to attain the requirements, the mandrel 300 of the die is also required to further reduce the gap 304 between the bearing portions 303 of the adjacent columnar portions 302 and/or the width of the bearing portion of each columnar portion 302.

In the mandrel 300, however, if the gap 304 between the bearing portions 303 of the adjacent columnar portions 302 is decreased, the extrusion material cannot be introduced into the gap 304 fully, causing defects of the partitioning wall 201 of the tube 200.

In order to avoid the aforementioned problem, as shown in FIG. 11, in some extrusion dies, a gap 305 between basal end portions of the adjacent columnar portions 302 is enlarged so that the gap becomes larger than the gap between the adjacent bearing portions 303 so that the extrusion material can be introduced into the enlarged gap 305 and therefore sufficient extrusion material can be supplied to the gap 304 between the adjacent bearing portion 303 to thereby prevent generation of defects due to insufficient extrusion material.

In cases where the number of small hollow portions of the tube exceeds a certain number, if the width of the bearing portion 303 of the columnar portion 302 is decreased in order to decrease the width of each hollow portion 202 of the tube 200, the thickness of the columnar portion 302 forming the enlarged gap 305 becomes thinner than the gap 304 of the bearing portion 303, causing decreased strength of the columnar portion 302, which results in an easy-to-break columnar portion. Thus, there is a limit to decrease the width of each hollow portion 202 of the tube 200.

DISCLOSURE OF INVENTION

It is an object of the present invention to provide an extrusion die for manufacturing a tube with a plurality of small hollow portions capable of preventing defects of partitioning walls and decreasing the width of the hollow portion.

It is another object of the present invention to provide a mandrel used for the aforementioned extrusion die for manufacturing a tube with a plurality of small hollow portions.

It is still another object of the present invention to provide to a multi-hollowed tube manufactured by using the aforementioned extrusion die.

It is still yet another object of the present invention to provide a manufacturing method of a heat exchanging tube using the aforementioned extrusion die.

It is still yet another object of the present invention to provide a heat exchanger using the aforementioned heat exchanging tubes and the manufacturing method of the heat exchanger.

In the first aspect of the present invention, an inwardly dented portion is formed on at least one of outside surfaces of a columnar portion of a mandrel opposed in a direction of a comb-shaped portion and the shape of the inwardly dented portion is specified.

According to the first aspect of the present invention, an extrusion die for manufacturing a tube with a plurality of small hollow portions arranged in a width direction of the tube, is equipped with a female die for defining an outer periphery of the tube, and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface.

With this extrusion die, as mentioned above, at least one of the outside surfaces of the columnar portion has an inwardly dented portion behind the bearing portion, the inwardly dented portion constitutes extrusion material filling space, the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface. Accordingly, at the time of extrusion, the extrusion material is smoothly flowed into the inwardly dented portion, and therefore sufficient extrusion material can be supplied to the gap between the adjacent bearing portions. As a result, even if the gap is decreased, generation of defects of partitioning walls caused by insufficient extrusion material can be prevented. Furthermore, an enlarged gap between the adjacent columnar portions formed by decreasing the thickness of each columnar portion in the width direction of the comb-shaped portion is not necessarily required, which enables the thickness of each columnar portion to be further decreased. This in turn can decrease the width of each hollow portion of the tube.

Furthermore, since the at least one of the outside surfaces extending from the dented portion to the bearing portion is formed into an inwardly curved surface, there exists no angular portion on the at least one of the outside surfaces of the columnar portion, which can avoid stress concentration to the angular portion of the columnar portion. This in turn can prevent breakage of the columnar portion.

Since at least one of the outside surfaces of the columnar portion has an inwardly dented portion behind the bearing portion, the columnar portion is decreased in size in the thickness direction of the comb-shaped portion, which deteriorates the strength of the columnar portion. Accordingly, in order to increase the strength, each columnar portion may be provided with a reinforcing rib protruded from a tip end thereof.

It is preferable that the width of the bearing portion is 2.0 mm or less and that the gap between adjacent bearing portions is 0.6 mm or less. In this case, effects of the present invention can be effectively obtained.

Each of the plurality of columnar portions may be provided with a groove formed on the at least one of the outside surfaces of the bearing portion. In this case, a protruded portion corresponding to the groove is formed in the multi-hollowed tube. Therefore, in cases where the multi-hollowed tube is used as a heat exchanging tube of a heat exchanger, the protruded portion can be used as an inner fin for increasing the surface area which contacts a refrigerant passing through the hollow portion.

According to the second aspect of the present invention, a mandrel to be combined with a female die for regulating an outer periphery of a tube with a plurality of small hollow portions arranged in a width direction of the tube to form an extrusion die for manufacturing the tube, includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface.

By combining this mandrel with the female die, a multi-hollowed tube with a plurality of hollow portions each having a small width and having no defect due to insufficient extrusion material can be obtained.

In this mandrel too, in order to increase the strength, each of the plurality of columnar portions may be provided with a reinforcing rib protruded from a tip end thereof. Furthermore, the width of the bearing portion may be 2.0 mm or less, and that the gap between adjacent bearing portions may be 0.6 mm or less. Each of the plurality of columnar portions may be provided with a groove formed on the at least one of the outside surfaces of the bearing portion.

According to the third aspect of the present invention, a tube with a plurality of small hollow portions partitioned by partitioning walls in a width direction of the tube is manufactured by using an extrusion die, the extrusion die comprising a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface.

With this tube, it is possible to obtain a partitioning wall with no defect due to insufficient extrusion material and decrease the width of each hollow portion.

In manufacturing this tube, the extrusion die having a plurality of columnar portions each provided with a reinforcing rib protruded from a tip end thereof may be used. Furthermore, in this tube, the width of the hollow portion may be 2.0 mm or less, and that the thickness of the partitioning wall may be 0.6 mm or less. The columnar portion of the extrusion die may be provided with a groove formed on the at least one of the outside surfaces of the bearing portion, whereby a protrusion is formed between adjacent partitioning walls in the hollow portion.

According to the fourth aspect of the present invention, a method for manufacturing a heat exchanging tube is performed by extruding extrusion material through an extrusion die, wherein the extrusion die comprises a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface.

According to the method, a heat exchanging tube having partitions with no defect due to insufficient extrusion material and having hollow portions small in width can be manufactured.

The method may be performed by using an extrusion die in which each of columnar portions is provided with a reinforcing rib protruded from a tip end thereof, the width of the bearing portion is 2.0 mm or less, the gap between adjacent bearing portions is 0.6 mm or less, and/or each of columnar portions is provided with a groove formed on the at least one of the outside surfaces of the bearing portion.

According to the fifth aspect of the present invention, a heat exchange is provided with a heat exchanging tube with a plurality of small hollow portions partitioned by partitioning walls in a width direction of the heat exchanging tube, the heat exchanging tube being manufactured by using an extrusion die, wherein the extrusion die comprises a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface.

Since this heat exchanger is provided with a heat exchanging tube having small hollow portions partitioned by partitioning walls with no defect due to insufficient extrusion material, the heat exchanging efficiency of the heat exchanging tube can be enhanced, which in turn can improve the heat exchanging efficiency of the entire heat exchanging tube.

In the fifth aspect of the present invention, each of the plurality of columnar portions may be provided with a reinforcing rib protruded from a tip end thereof, a width of the bearing portion may be 2.0 mm or less, the gap between adjacent bearing portions may be 0.6 mm or less, and a fin portion may be protruded between adjacent partitioning walls in each of the plurality of small hollow portions.

According to the sixth aspect of the present invention, a method for manufacturing a heat exchanger is performed by brazing heat exchanging tubes and outer fins arranged alternatively, each of the heat exchanging tube having a plurality of small hollow portions partitioned by partitioning walls in a width direction of the heat exchanging tube, the heat exchanging tube being manufactured by an extrusion die, wherein the extrusion die comprises a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface.

In this method, since a heat exchanging tube having partitioning walls with no defect due to insufficient extrusion material and having small hollow portions is used, the heat exchanging efficiency of the heat exchanging tube can be enhanced, which in turn can improve the heat exchanging efficiency of the entire heat exchanging tube.

In the sixth aspect of the invention, each of the plurality of columnar portions may be provided with a reinforcing rib protruded from a tip end thereof, the width of the hollow portion may be 2.0 mm or less, the thickness of the partitioning wall may be 0.6 mm or less and/or the fin portion may be protruded between adjacent partitioning walls in each of the plurality of small hollow portions.

Other objects and features of the present invention will become more apparent from the following explanation with reference to the attached drawings.

BEST MODE FOR CARRYING OUT THE INVENTION

Figure 7A:
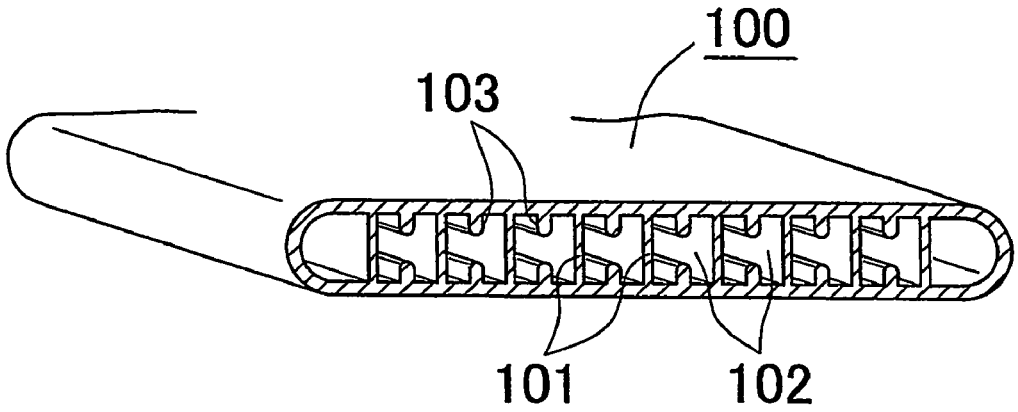
FIG. 7A is a cross-sectional perspective view of an extrusion aluminum tube manufactured by the extrusion die shown in FIGS. 1 to 4.
Figure 7B:
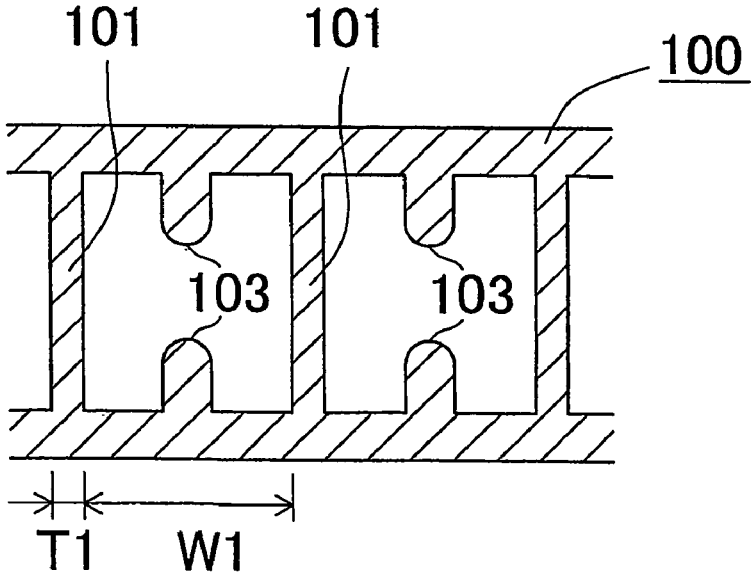
FIG. 7B is an enlarged front cross-sectional view showing the tube.

In the embodiment explained below, as shown in FIGS. 7A and 7B, a multi-hollowed tube to be manufactured by an extrusion method is an aluminum (or its alloy) flat tube 100 having a number of small hollow portions 102 partitioned by partitioning walls 101 and arranged in the width direction of the flat tube 100, and the flat tube is used as a heat exchanging tube for a heat exchanger through which refrigerant passes. The wall portions opposed in the thickness direction of the aluminum tube (the up-and-down direction in FIG. 7) is provided with a pair of fin portions 103 integrally protruding from the wall portions toward the opposite wall portion to a middle portion at the widthwise central portion of each hollow portion except for the opposite hollow portions located at the widthwise ends of the flat tube (at the right and left ends in FIG. 7A). Accordingly, each of the hollow portions except for the hollow portions located at the widthwise ends of the flat tube has an H-shaped cross-sectional configuration.

Figure 1A:
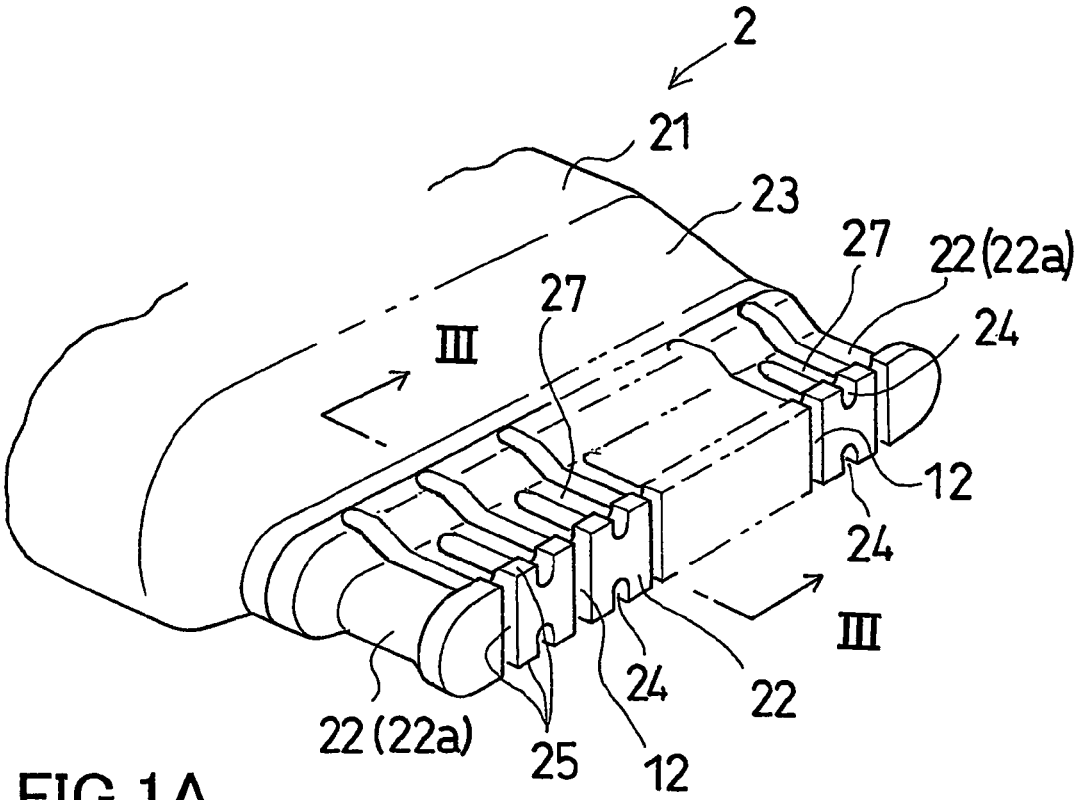
FIG. 1A is a perspective view showing a mandrel of an extrusion die according to an embodiment of the present invention.
Figure 1B:
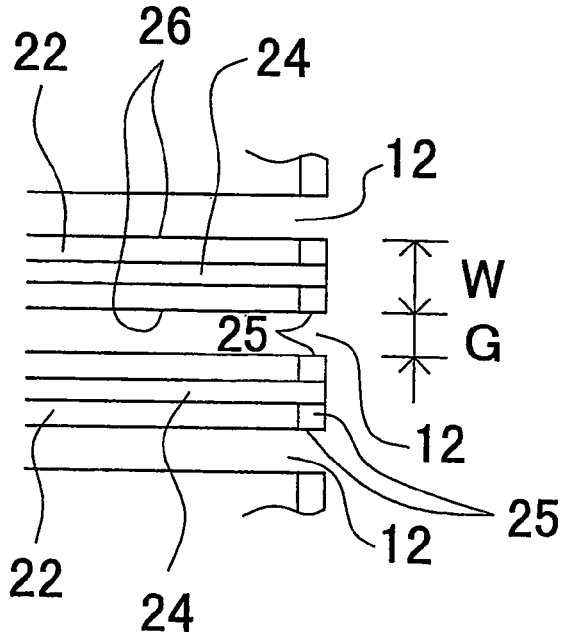
FIG. 1B is the plane view of the columnar portions.
Figure 2:
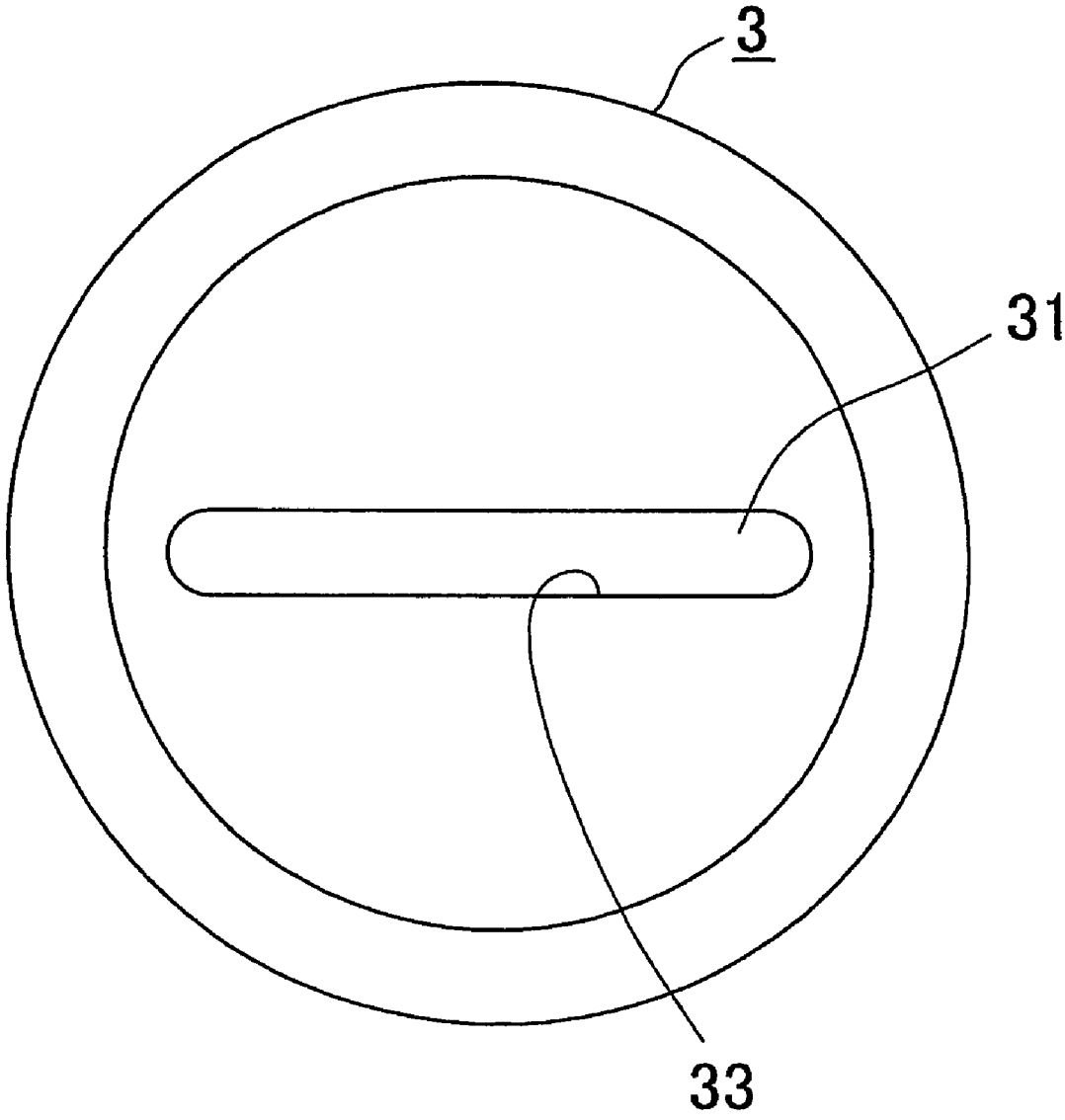
FIG. 2 is a front view of the female die of the extrusion die seen from the rear side thereof (inlet side).
Figure 3:
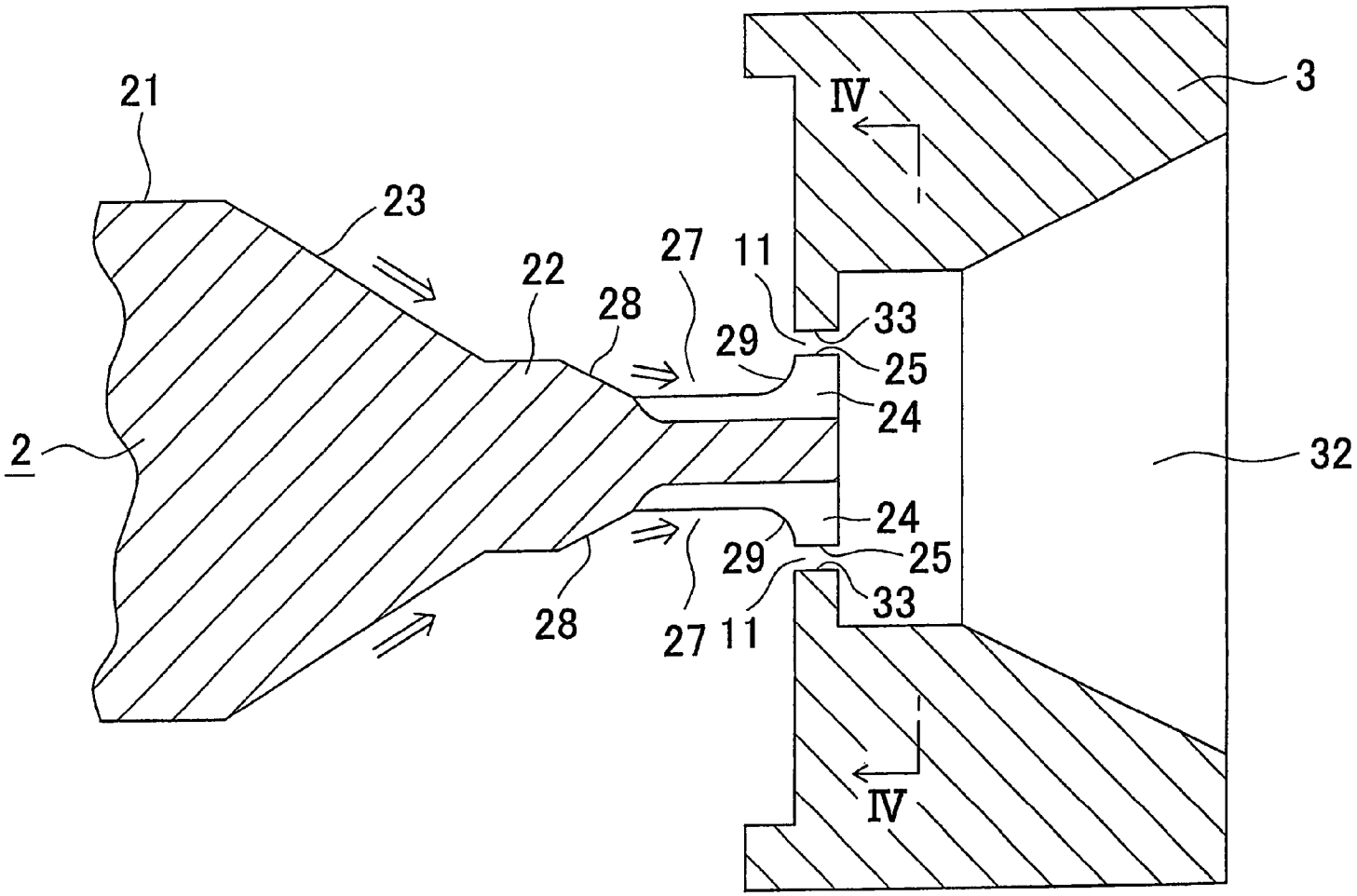
FIG. 3 is a cross-sectional view showing the principal part of the extrusion die in which the female die and the mandrel are combined.
Figure 4:
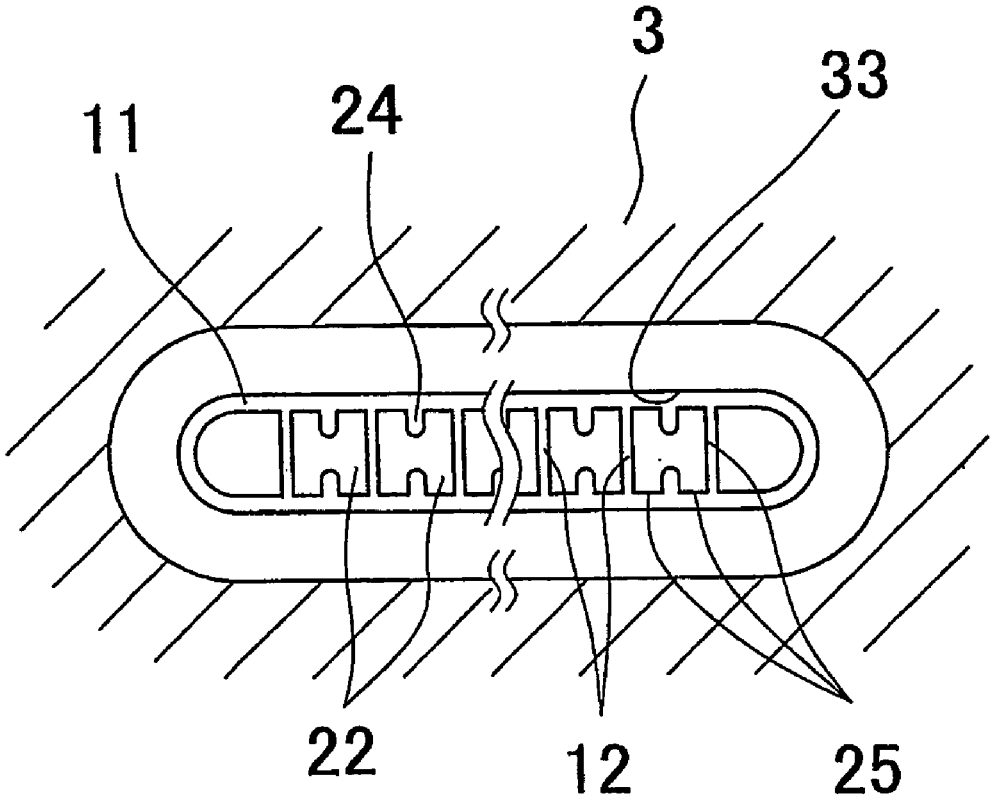
FIG. 4 is a cross-sectional view taken along the line IV—IV in FIG. 3.

FIG. 1 is a perspective view showing a mandrel 2 of an extrusion die 1 according to one embodiment of the present invention, FIG. 2 is a front view of the female die seen from the rear side thereof (inlet side), FIG. 3 is a cross-sectional taken along the line III—III in FIG. 1 in the state where the female-die die 3 and the mandrel 2 are combined, and FIG. 4 is a cross-sectional view taken along the line IV—IV in FIG. 3.

In FIGS. 1 to 4, the female die 3 has a flat opening 31 corresponding to the outer periphery of the aluminum tube 100 at the central portion of the rear surface thereof and an extruded-member passing aperture 32 which penetrates the female die 3 in the axial direction thereof with the aperture 32 communicated with the flat opening 31. The inner periphery of the opening 31 constitutes a bearing portion 33 for defining the outer periphery of the aluminum tube.

On the other hand, the mandrel 2 has a flat mandrel body 21 and a comb-shaped portion integrally protruded from the tip portion of the mandrel body 21 and having a plurality of columnar portions 22 arranged in a row at certain intervals along the widthwise direction (the right-and-left direction in FIG. 4) of the comb-shaped portion.

The connecting portion 23 of the mandrel body 21 connected to the columnar portions 22 is formed to have outer surfaces opposed in the thickness direction (in the up-and-down direction in FIG. 4) and tapered towards the tip thereof. Therefore, the extrusion material on both thickness sides of the mandrel body 21 can be easily introduced towards the columnar portions 22 at the time of extrusion.

Each columnar portion 22 is a portion for forming the hollow portion 102 of the aluminum tube 100, and therefore the configuration of the tip portion corresponds to the cross-section of each hollow portion 102. That is, each of the columnar portions 22 except for the outermost columnar portions 22*a* located at the widthwise end of the comb-shaped portion is provided with grooves 24 for forming the fin portions 103 of the aluminum tube 100 on the outside surfaces opposed in the thickness direction of the comb-shaped portion. Each groove 24 has a certain depth in the thickness direction of the comb-shaped portion. Accordingly, each columnar portion 22 is formed into an H-shape in cross-section corresponding to the cross-section of the hollow portion 102 of the aluminum tube 100. Each groove 24 extends to near the basal end portion of the columnar portion 22. Furthermore, the outer periphery of the tip end portion of the columnar portion 22 constitutes a bearing portion 25 which regulates the inner periphery of the hollow portion of the aluminum tube 100.

The outside surfaces of the columnar portions 22 opposed in the thickness direction of the comb-shaped portion have inwardly dented portions 27 behind the bearing portion 25, and these inwardly dented portions 27 constitute extrusion material filling spaces.

Furthermore, as shown in FIG. 3 in detail, each of the outside surfaces 28 extending from the basal end portion of the columnar portion 22 to the inwardly dented portion 27 is formed into an inclined surface, which enhances the introduction of the extrusion material into the inwardly dented portion 27. In place of the inclined surface, the outside surface 28 may be formed into a curved surface capable of promoting the introduction of extrusion material to the inwardly dented portion 27.

On the other hand, each of the outside surfaces 29 extending from the inwardly dented portion 27 to the bearing portion 25 is formed into an inwardly curved surface. The reason that the outside surface 29 is formed into an inwardly curved surface is to prevent the existence of any angular portion on the outside surface 29 extending from the basal end portion to the bearing portion 25 to thereby prevent breakage of the columnar portion due to stress concentration to the angular portion of the columnar portion.

In this embodiment, the columnar portion 22 is formed to have a constant thickness and flat side surfaces extending from the basal end portion to the bearing portion 25. The bearing portion 25 of the columnar portion 22 may be protruded sideways. In this case, the stepped portion formed between the protruded bearing portion and the side surface of the columnar portion may also be formed into a curved surface in the same manner as the outside surface of the columnar portion in the thickness direction of the comb-potion behind the bearing portion 25. In cases where the columnar portion 22 has a sufficient thickness, an enlarged gap portion may be formed between the adjacent columnar portions 22 and 22.

The aforementioned mandrel 2 is combined with the female die 31 by disposing the tip end portion of the columnar portion 22 in the opening 31 of the female die 3 so that the bearing portion 25 at the tip of the columnar portion 22 is opposed to the bearing portion 33 of the female die 3 to thereby constitute a die 1. If necessary, the mandrel 2 may be combined with the female die with the mandrel 2 held by a support member (not shown) by shrinkage fitting or the like. Furthermore, the mandrel 2 may be divided into, for example, a mandrel body 21 and a comb-shaped portion, and then these members may be fixed with each other by shrinkage fitting or the like.

In this state, an aluminum billet as extrusion material is inserted in a container (not shown) in which the die 1 is set, and then an extrusion is performed according to a conventional method. At both surfaces of the mandrel 2 opposed in the thickness direction of the comb-shaped portion, as shown by the arrows in FIG. 3, by the extrusion pressure, the aluminum extrusion material is flown towards the columnar portions 22 along the inwardly inclined surfaces of the connecting portion 23 of the mandrel 21 and filled in the inwardly dented portions 27 formed at both outside surfaces of the columnar portions 22 opposed in the thickness direction of the comb-shaped portion.

When extrusion pressure is further applied, the extrusion material filled in the inwardly dented portions is extruded through the gap between the bearing portion 25 of the columnar portion 22 and the bearing portion 33 of the female die. Simultaneously, the extrusion material is supplied to the gap between the adjacent columnar portions 22 and then extruded through the bearing portions of the adjacent columnar portions 22. Thus, the extrusion material is continuously extruded through the gaps 11 and 12, whereby the aluminum extrusion tube 100 of the cross-section as shown in FIG. 7 is manufactured.

At the time of extrusion, the bearing portion 25 of each columnar portion 22 receives forward stress via the extrusion material filled in the inwardly dented portions 27. However, since the surface 29 extending from the inwardly dented portion 27 to the bearing portion 25 is formed into a curved surface and no angular portion exists on the surface 29, the stress is dispersed, which prevents breakage of the columnar portion 22.

In the extrusion die according to this embodiment, the inwardly dented portions 27 are formed on both outside surfaces of the columnar portion 22 opposed in the thickness direction of the comb-shaped portion, and no enlarged gap is formed between the adjacent columnar portions 22. Accordingly, the width of the bearing portion of each columnar portion 22 can be further decreased, compared with the case where the width of each columnar portion 22 is decreased in order to form an enlarged gap between the adjacent columnar portions. Thus, the width of the hollow portion 102 of the aluminum tube can be decreased.

Furthermore, since the inwardly dented portions 27 are formed at both outer surfaces of the columnar portion 22 opposed in the thickness direction of the comb-shaped portion, sufficient extrusion material can be supplied to the gap 12 between the adjacent columnar portions 22, like the case in which an enlarged gap is formed between the adjacent columnar portions. As a result, even if the gap 12 between the adjacent columnar portions 22 is decreased, generation of defects of the partitioning wall due to insufficient extrusion material can be prevented.

Concretely, as shown in FIG. 1B, in cases where the width W of the columnar portion 22 of the bearing portion 25 is set 2.0 mm or less and the gap G between the bearing portions of the adjacent columnar portions 22 and 22 is set 0.6 mm or less, the aforementioned effects can be obtained more effectively. In other words, in cases where an extrusion aluminum tube 100 with the thickness T1 of a partitioning wall 101 of 0.6 mm or less and the width W1 of the hollow portion 102 of 2.0 mm or less is manufactured, the aforementioned effects can be obtained more effectively.

Figure 5A:
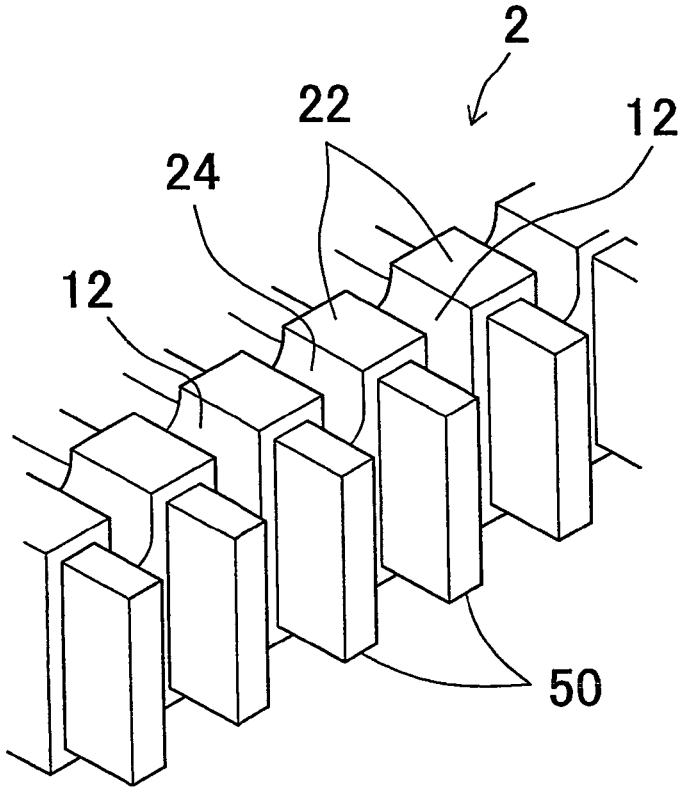
FIG. 5A is a perspective view of a principal part of a mandrel according to a modified embodiment of the present invention.
Figure 5C:
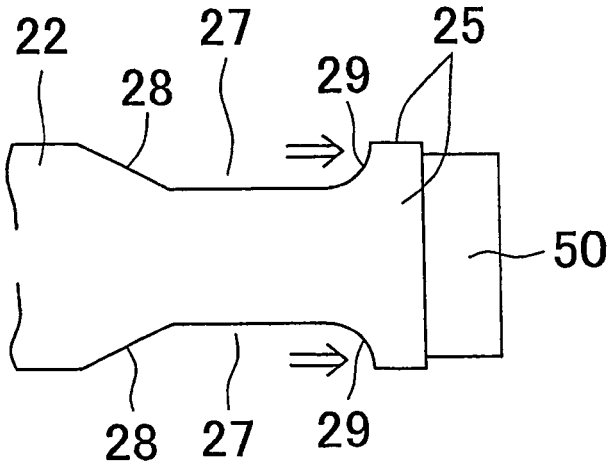
FIG. 5C is a side view of the columnar portion.
Figure 5B:
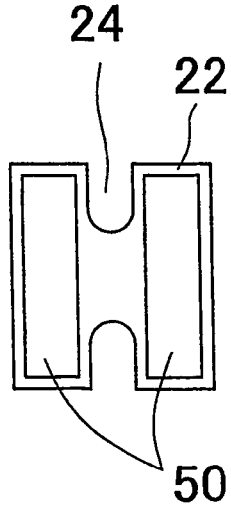
FIG. 5B is a front view of the columnar portion seen from the extrusion exit side.

FIG. 5 shows a modified embodiment of the present invention. In this modified embodiment, two reinforcing ribs 50 are protruded from the H-shaped tip end of the columnar portion 22 along the longitudinal portions of the H-shaped tip end, respectively. Thereby, the columnar portion 22 can be strengthened against the back pressure (shown by arrows in FIG. 5C) applied to the bearing portion 25 of the columnar portion 22 at the time of extrusion.

Figure 6:
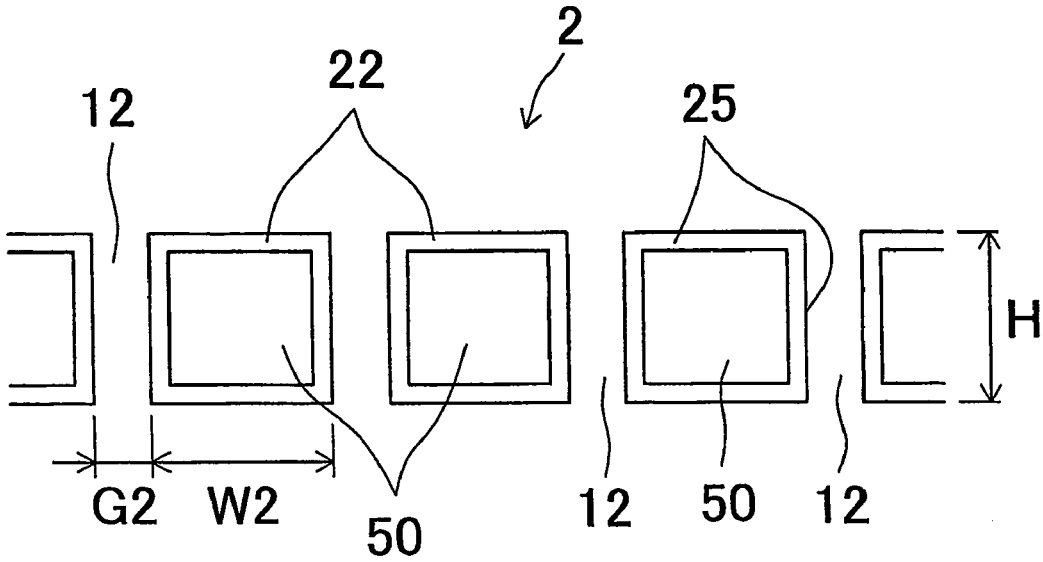
FIG. 6 is a front view of a principal part of a mandrel according to another embodiment of the present invention seen from the extrusion exist side.
Figure 8A:
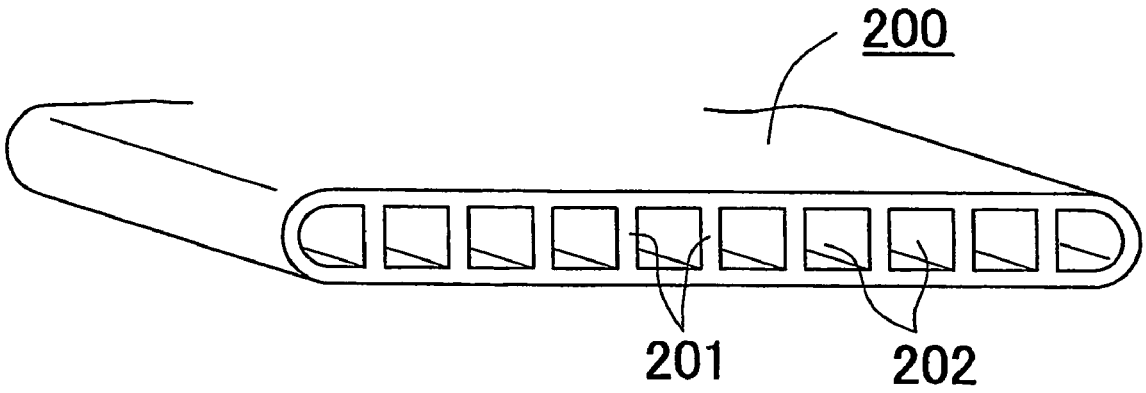
FIG. 8A is a cross-sectional perspective view of an extruded aluminum pipe manufactured by the die equipped with the mandrel shown in FIG. 6.
Figure 8B:
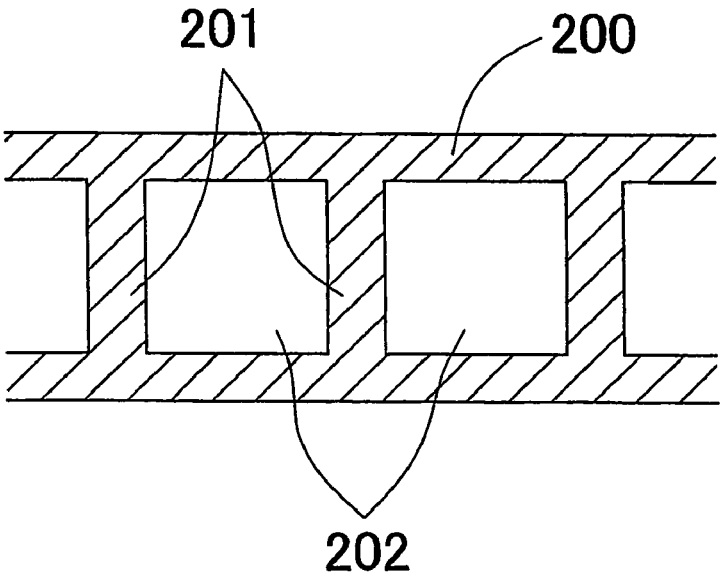
FIG. 8B is an enlarged front cross-sectional view thereof.

Furthermore, in the above embodiment, an aluminum tube 100 with a plurality of hollow portions 102 each having an H-shaped cross-section is extruded by using the die in which the columnar portion of the mandrel 2 is formed to have an H-shaped cross-section. In place of the above, however, as shown in FIG. 6, an aluminum tube 200 having a number of rectangular hollow portions 202 partitioned by partitioning walls 201 as shown in FIG. 8 may be extruded by using a die in which each columnar portion 22 is formed into a rectangular shaped in cross-section. In FIG. 6, the reference numeral 50 denotes a protruded reinforcing rib provided on the tip of the columnar portion 22. Such a reinforcing rib may be provided if necessary.

Figure 9:
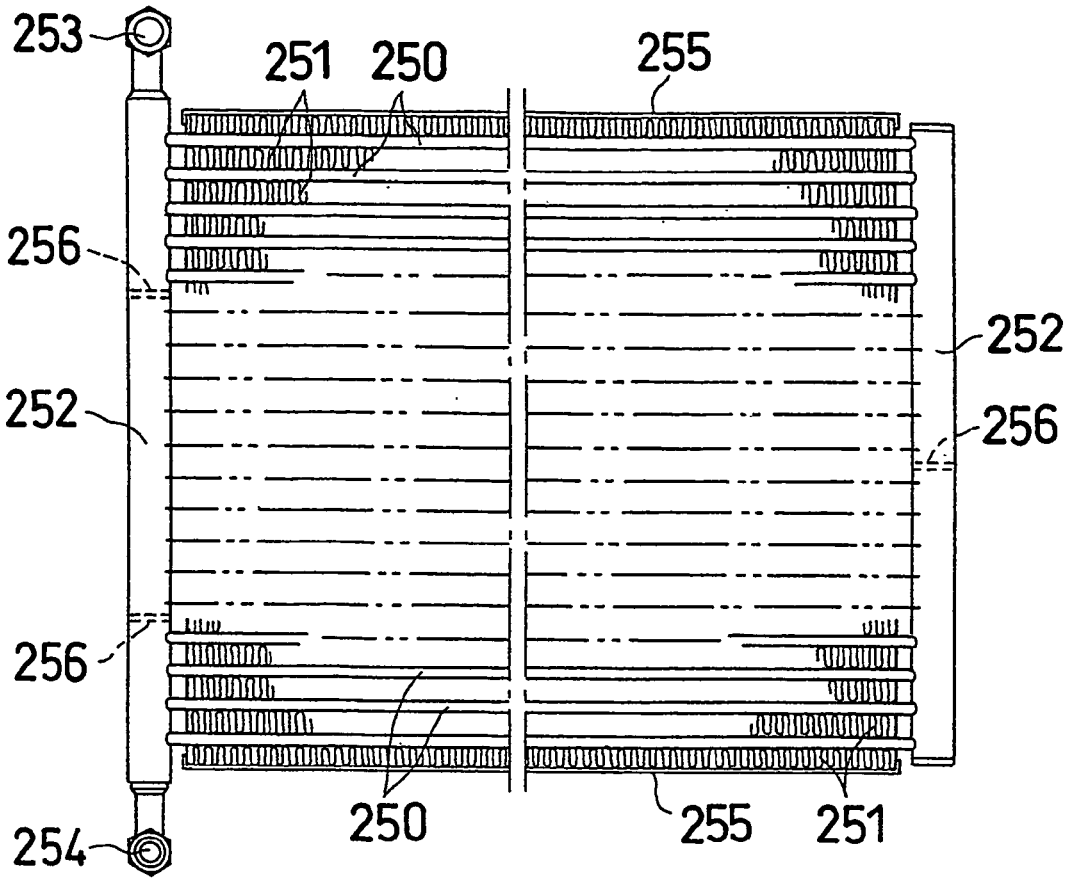
FIG. 9 is a front view showing a heat exchanger according to an embodiment of the present invention.

FIG. 9 is a front view showing a parallel flow type condenser as a heat exchanger having the aforementioned aluminum tubes 100 or 200 as heat exchanging tubes 250.

This condenser includes heat exchanging tubes 250 consisting of the aluminum tubes 100 or 200 and corrugated aluminum outer fins 251 alternatively disposed in an up-and-down direction, wherein both ends of the heat exchanging tubes 250 are connected to a pair of aluminum headers 252 and 252. The heat exchanging tubes 250 and the headers 252 are brazed, and the heat exchanging tubes 250 and the outer fins 251 are also brazed each other.

In FIG. 9, the reference numeral 253 denotes a refrigerant inlet, 254 denotes a refrigerant outlet, 255 denotes a pair of side plates disposed on the outermost outer fins, and 256 denotes a partition for dividing the inside of each header 252 to make the refrigerant passage constituted by heat exchanging tubes into a meandering passage. These heat exchanger components are also joined to the correspondence portions by brazing.

In this heat exchanger, as a heat exchanging tube 250, since the aluminum tube 100 or 200 in which the width of the hollow portion is small and the thickness of the partitioning wall is thin is used, this heat exchanger is excellent in heat exchange efficiency. In cases where the aluminum tubes 100 are used as heat exchanging tubes 250, since the fin portion protruded between the adjoining partitioning walls functions as an inner fin, the heat exchange efficiency can be further improved.

EXAMPLE

The following examinations were performed in order to confirm the effects of the die according to this embodiment.

Example 1

As a die 1 for extruding the aluminum tube 200 with a plurality of hollow portions 202 each having a rectangular cross-section as shown in FIG. 8, conventional extrusion dies each provided with a mandrel 2 having a plurality of columnar portions 22 each having a rectangular cross-section as shown in FIG. 6 and having an enlarged gap between adjacent columnar portions and invention extrusion dies according to the present invention in which no enlarged gap is formed between the adjacent columnar portions 22 and inwardly dented portions are formed on outside surfaces opposed in the thickness direction of the comb-shaped portion were prepared. No reinforcing rib was provided at the tip of the columnar portion in each die.

Figure 10:
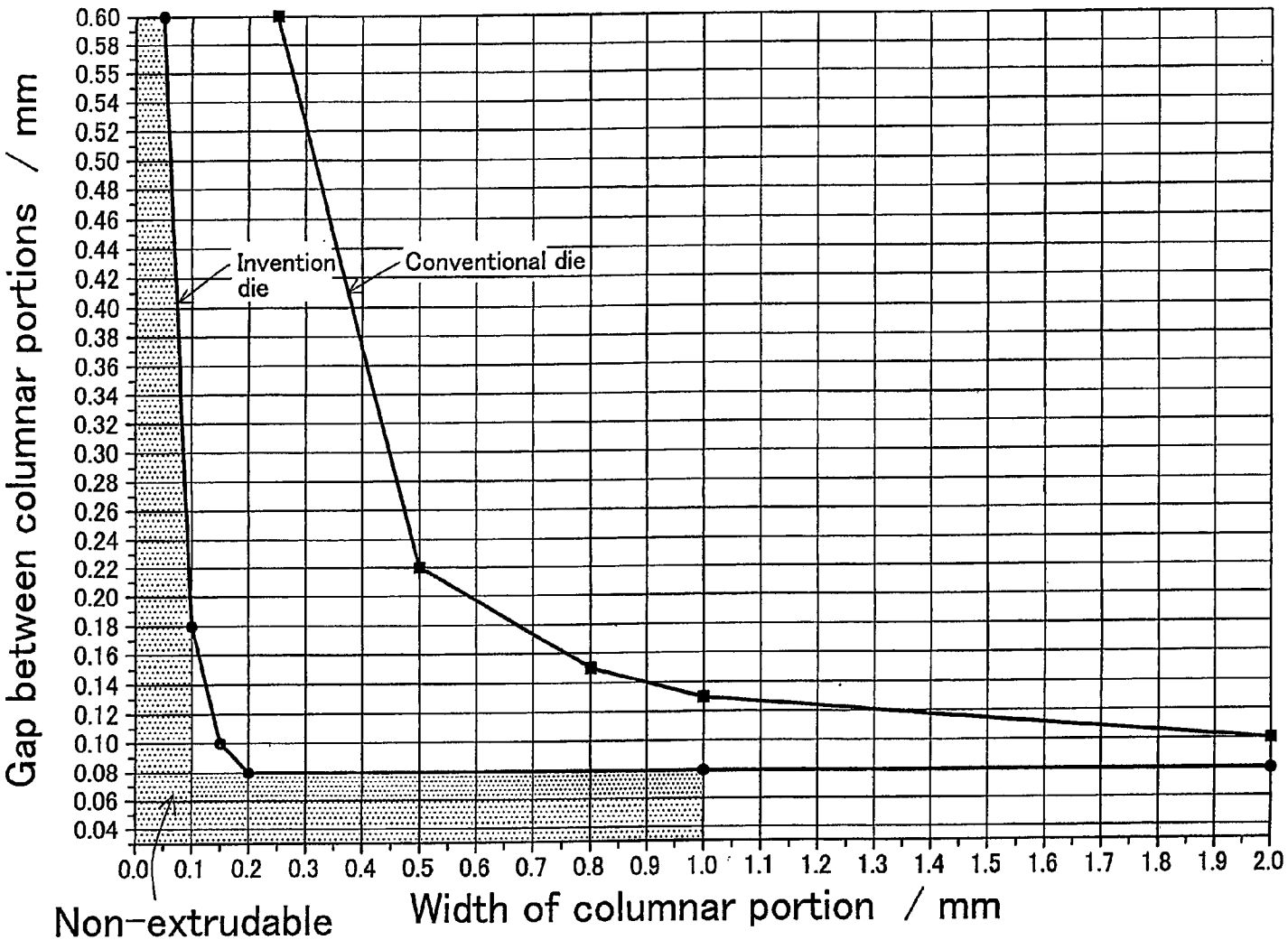
FIG. 10 is a graph showing the results of the marginal test of the extrusion nature performed to the examples.
Figure 11:
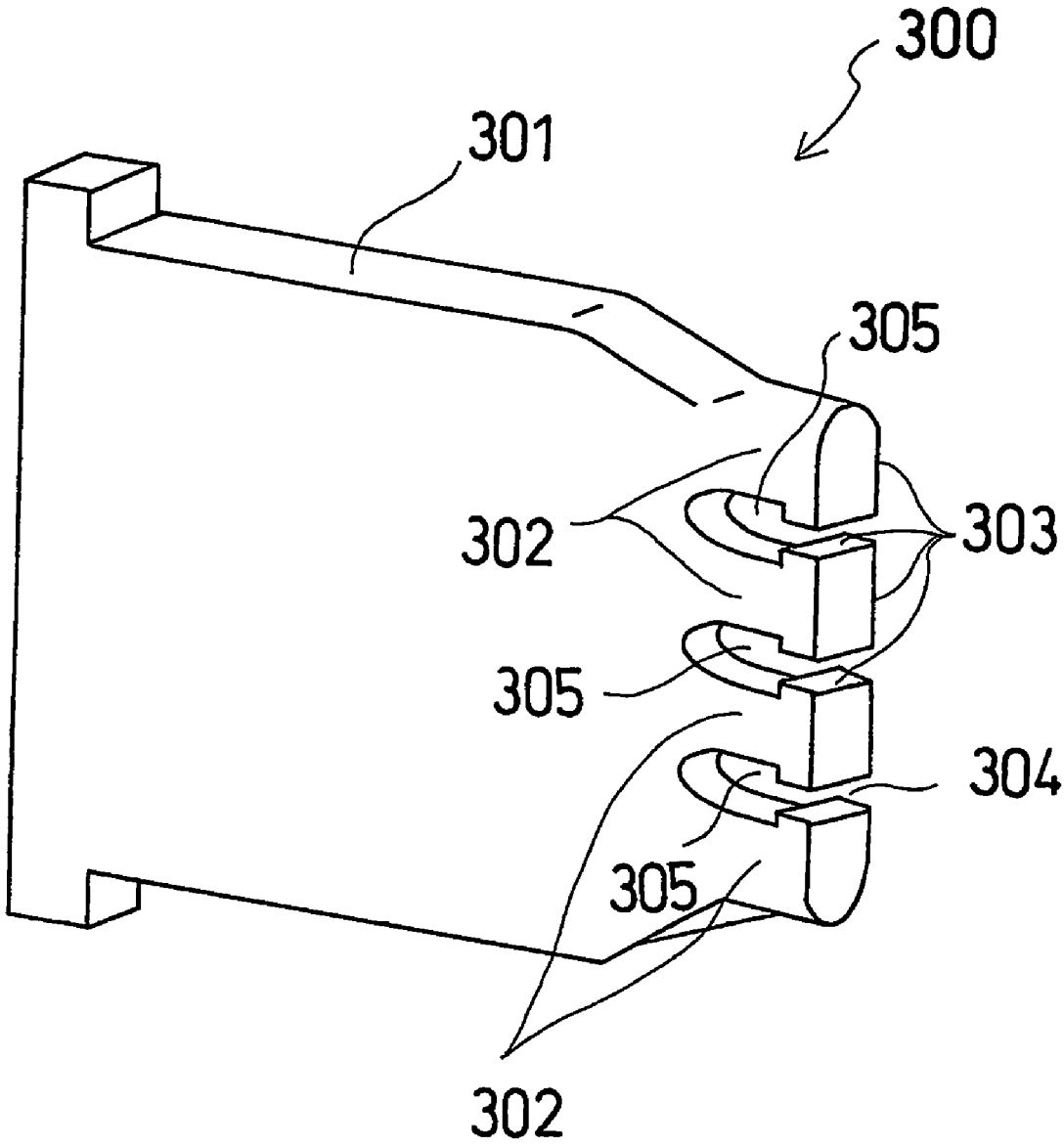
FIG. 11 is a perspective view showing a mandrel used for a conventional extrusion die.

Various conventional dies and invention dies different in width W2 (see FIG. 6) of the columnar portion 22 and gap G2 between the adjacent columnar portions 22 but constant in height H of the bearing portion 25 (1.5 mm high) as shown in Table 1 were used to extrude an aluminum billet evaluate the limitation of extrusion nature. The results are shown in Table 1 and FIG. 10. In FIG. 10, the vertical axis shows the size G2 of the gap 12 between the adjacent columnar portions 22, and the horizontal axis shows the width W2 of the columnar portion 22. Furthermore, the line connecting black square points shows the extrusion limit of the conventional die, and the line connecting black dot points shows the extrusion limit of the invention die. The upper right region above each line shows a range in which extrusion can be performed well and the lower left region below each line shows a range in which extrusion becomes poor or it is difficult to perform extrusion.

TABLE 1

| | | Columnar portion (size, etc) | | | |
|---|---|---|---|---|---|
| Die No. | | Height H (mm) | Width W2 (mm) | Gap G2 (mm) | Results |
| Example | 1 | 1.5 | 2.0 | 0.08 | No defect, No damage occurred |
| | 2 | 1.5 | 1.0 | 0.08 | |
| | 3 | 1.5 | 0.20 | 0.08 | |
| | 4 | 1.5 | 0.15 | 0.10 | |
| | 5 | 1.5 | 0.10 | 0.18 | |
| | 6 | 1.5 | 0.05 | 0.60 | |
| Comparative Example | 7 | 1.5 | 2.0 | 0.10 | Defects due to insufficient material, Damages occurred |
| | 8 | 1.5 | 1.0 | 0.13 | |
| | 9 | 1.5 | 0.8 | 0.15 | |
| | 10 | 1.5 | 0.5 | 0.22 | |
| | 11 | 1.5 | 0.25 | 0.60 | |

As can be understood from Table 1 and FIG. 10, in the conventional dies in which an enlarged gap is formed between the adjacent columnar portions of the mandrel, when the width W2 of the columnar portion was 2.0 mm and the gap G2 was 0.1 mm, defects of the partitioning wall 201 due to insufficient extrusion material occurred, or the columnar portion itself was damaged. Furthermore, when the width W2 of the columnar portion 22 was 1.0 mm, 0.8 mm, 0.5 mm or 0.25 mm, defects of the partitioning wall 201 due to insufficient extrusion material occurred, or the columnar portion itself was damaged when the gap G2 was 0.13 mm, 0.15 mm, 0.22 mm or 0.60 mm, respectively. On the other hand, in the embodiments of the present invention in which inwardly dented portions are formed on the outside surfaces opposed in the thickness direction of the comb-shaped portion, no defect due to insufficient extrusion material occurred to the partitioning wall 201 or no damage of the columnar portion 22 occurred when the width W2 of the columnar portion 22 was 0.2 mm or more or the gap G2 was 0.08 mm or more. Furthermore, when the width W2 of the columnar portion 22 was 0.15 mm, 0.10 mm or 0.05 mm, even if the gap G2 was 0.10 mm, 0.18 mm or 0.60 mm, respectively, neither defect of the partitioning wall 201 due to insufficient extrusion material nor breakage of the columnar portion 22 occurred.

Accordingly, according to the embodiment of the present invention, it is confirmed that the extrusion limit can be raised.

In the dark region shown in FIG. 10, even in the embodiment of the present invention, it was difficult to perform extrusion.

Example 2

In Example 2, a mandrel which is the same type as in Example 1 was used. Conventional dies each provided with a mandrel 2 having a plurality of columnar portions 22 each having a rectangular cross-section as shown in FIG. 6 and having an enlarged gap between adjacent columnar portions and invention dies according to the present invention in which no enlarged gap is formed between the adjacent columnar portions 22 and inwardly dented portions are formed on outside surfaces opposed in the thickness direction of the comb-shaped portion were prepared. No reinforcing rib 50 was provided at the tip of the columnar portion in each die.

In the conventional dies and the invention dies, the width W2 of the columnar portion 22 were set 0.5 mm, 0.8 mm and 1.0 mm while keeping the height H of the bearing portion 25 of the columnar portion 22 constant (0.7 mm height) and keeping the gap G2 between the adjacent columnar portions 22 constant (0.2 mm height), and aluminum billets were extruded to evaluate the life of the dies.

As a result, in cases where the width W2 of the columnar portion 22 was 0.5 mm, in conventional dies, when a total 0.9 tons of billets was extruded, the die life was terminated. To the contrary, in the embodiments of the present invention, when a total 2.1 tons of billet was extruded, the die life was terminated. Accordingly, the die life of the embodiment of the present invention is about 2.3 times the die life of the conventional die. Furthermore, in cases where the width W2 of the columnar portion 22 was 0.8 mm, the total amount of extruded material reaching the die life of the conventional die was 1.5 tons, while that of the embodiment of the invention die was 2.5 tons which is about 1.6 times the die life of the conventional die. Furthermore, in cases where the width W2 of the columnar portion 22 was 1.0 mm, the total amount of extruded material reaching the die life of the conventional die was 2.2 tons, while that of the embodiment of the invention die was 2.6 tons which is about 1.18 times the die life of the conventional die.

As will be apparent from the above, it is confirmed that according to the embodiments of the present invention the die life can be notably extended especially in cases where the width W2 of the columnar portion 22 was decreased.

As mentioned above, according to the extrusion die for manufacturing a tube with a plurality of small hollow portions arranged in a width direction of the tube, which is equipped with a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface, at the time of extrusion, the extrusion material can be smoothly flowed into the inwardly dented portion, and therefore sufficient extrusion material can be supplied to the gap between the adjacent bearing portions.

As a result, even if the gap is decreased, generation of defects due to insufficient extrusion material can be prevented. Furthermore, an enlarged gap between the adjacent columnar portions formed by decreasing the thickness of each columnar portion in the width direction of the comb-shaped portion is not necessarily required, which enables the width of each columnar portion to be further decreased. This in turn can decrease the width of each hollow portion of the tube.

Furthermore, since the at least one of the outside surfaces extending from the dented portion to the bearing portion is formed into an inwardly curved surface, there is no angular portion on the at least one of the outside surfaces of the columnar portion, which can avoid stress concentration to the angular portion of the columnar portion. This in turn can prevent breakage of the columnar portion.

In the aforementioned extrusion die, in cases where each columnar portion is provided with a reinforcing rib protruded from a tip end thereof, the strength of the mandrel can be improved.

Furthermore, according to the aforementioned die, it is possible to extrude a multi-hollowed tube having a plurality of small hollow portion by a die in which the width of the bearing portion is 2.0 mm or less and that the gap between the adjacent bearing portions is 0.6 mm or less.

In cases where each of the plurality of columnar portions is provided with a groove on the at least one of the outside surfaces of the bearing portion, a protruded portion corresponding to the groove can be formed in the multi-hollowed tube. Therefore, in cases where the multi-hollowed tube is used as a heat exchanging tube of a heat exchanger, the protruded portion can be used as an inner fin for increasing the surface area which contacts a refrigerant passing though the hollow portion.

According to a mandrel to be combined with a female die for regulating an outer periphery of a tube with a plurality of small hollow portions arranged in a width direction of the tube to form an extrusion die for manufacturing the tube, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface, by combining this mandrel with the female die, a multi-hollowed tube with a plurality of hollow portions each having a small width and having no defect due to insufficient extrusion material can be obtained.

In this mandrel, in cases where each of the plurality of columnar portions is provided with a reinforcing rib protruded from a tip end thereof, the strength can be increased.

Furthermore, in cases where the width of the bearing portion is 2.0 mm or less and the gap between adjacent bearing portions is 0.6 mm or less, a multi-hollowed tube having very small hollow portions can be obtained.

In cases where each of the plurality of columnar portions is provided with a groove on the at least one of the outside surfaces of the bearing portion, a protruded portion corresponding to the groove can be used as, for example, an inner fin of a heat exchanger.

According to the tube with a plurality of small hollow portions partitioned by partitioning walls in a width direction of the tube manufactured by using an extrusion die comprising a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface, it is possible to obtain a partitioning wall with no defect due to insufficient extrusion material and decrease the width of each hollow portion.

In this multi-hollowed tube, in cases where each of the plurality of columnar portions is provided with a reinforcing rib protruded from a tip end thereof, since the mandrel strength can be increased, it is possible to obtain a partitioning wall with no defect due to insufficient extrusion material and further decrease the width of each hollow portion.

In cases where the width of the hollow portion is 2.0 mm or less and the thickness of the partitioning wall is 0.6 mm or less, it is possible to obtain a multi-hollowed tube having a plurality of hollow portions partitioned by thinner partitioning walls and having a small width.

In cases where the columnar portion is provided with a groove formed on the at least one of the outside surfaces of the bearing portion, whereby a protrusion is formed between adjacent partitioning walls in the hollow portion, the protrusion may be used as an inner fin of a heat exchanging tube.

According to the method for manufacturing a heat exchanging tube performed by extruding extrusion material through an extrusion die, wherein the extrusion die comprises a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface, a heat exchanging tube having partitions with no defect due to insufficient extrusion material and having hollow portions small in width can be manufactured.

In cases where the method is performed by using an extrusion die having a plurality of columnar portions each provided with a reinforcing rib protruded from a tip end thereof, since the mandrel strength can be increased, a heat exchanging tube having partitions with no defect due to insufficient extrusion material and having hollow portions smaller in width can be manufactured.

In cases where the width of the bearing portion of 2.0 mm or less and the gap between adjacent bearing portions of 0.6 mm or less, a heat exchanging tube in which the width of the hollow portion is 2.0 mm or less and the thickness of the partitioning wall is 0.6 mm or less can be manufactured.

In cases where the columnar portion is provided with a groove formed on the at least one of the outside surfaces of the bearing portion, a heat exchanging tube in which a fin is protruded between the adjacent partitioning walls in the hollow portion can be manufactured.

According to the heat exchange provided with a heat exchanging tube with a plurality of small hollow portions partitioned by partitioning walls in a width direction of the heat exchanging tube, the heat exchanging tube being manufactured by using an extrusion die, wherein the extrusion die comprises a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface, due to the heat exchanging tube having small hollow portions partitioned by partitioning walls with no defect due to insufficient extrusion material, the heat exchanging efficiency of the heat exchanging tube can be enhanced, which in turn can improve the heat exchanging efficiency of the entire heat exchanging tube.

In this heat exchanging tube, in cases where each of the plurality of columnar portions is provided with a reinforcing rib protruded from a tip end thereof, the heat exchanging tube having smaller hollow portions partitioned by partitioning walls with no defect due to insufficient extrusion material can be obtained, and therefore a heat exchanger which is further improved in heat exchanging efficient can be obtained.

In this heat exchanger, in cases where the width of the bearing portion is 2.0 mm or less and the gap between adjacent bearing portions is 0.6 mm or less, since the width of the hollow portion of the heat exchanging tube is small and the thickness of the partitioning wall is thin, the heat exchanging efficiency can be improved.

In cases where a fin portion is protruded between adjacent partitioning walls in each of the plurality of small hollow portions, the contact between the refrigerant passing through the heat exchanging tube and the fin portion further improves the heat exchanging efficiency.

According to the method for manufacturing a heat exchanger performed by brazing heat exchanging tubes and outer fins arranged alternatively, each of the heat exchanging tube having a plurality of small hollow portions partitioned by partitioning walls in a width direction of the heat exchanging tube, the heat exchanging tube being manufactured by a die, wherein the die comprises a female die for defining an outer periphery of the tube and a mandrel combined with the female die, wherein the mandrel includes a body portion and a comb-shaped portion protruded from the body portion, the comb-shaped portion including a plurality of columnar portions disposed in a width direction of the comb-shaped portion at certain intervals, wherein an outer periphery of a tip end portion of each of the plurality of columnar portions constitutes a bearing portion for defining an inner periphery of each of the plurality of small hollow portions of the tube, wherein each of the plurality of columnar portions has outside surfaces opposed in a thickness direction of the comb-shaped portion, and at least one of the outside surfaces has an inwardly dented portion behind the bearing portion, the inwardly dented portion constituting an extrusion material filling space, and wherein the at least one of the outside surfaces extending from a basal end portion of each of the plurality of columnar portions to the inwardly dented portion is formed into an inclined or curved surface for leading extrusion material to the inwardly dented portion, and the at least one of the outside surfaces extending from the dented portion to the bearing portion is formed into an inwardly curved surface, due to the heat exchanging tube having small hollow portions partitioned by partitioning walls with no defect due to insufficient extrusion material, the heat exchanging efficiency of the heat exchanging tube can be enhanced, which in turn can improve the heat exchanging efficiency of the entire heat exchanging tube.

In cases where each of the plurality of columnar portions is provided with a reinforcing rib protruded from a tip end thereof, the heat exchanging tube having smaller hollow portions partitioned by partitioning walls with no defect due to insufficient extrusion material can be obtained, and therefore a heat exchanger which is further improved in heat exchanging efficient can be obtained.

In cases where the width of the hollow portion is 2.0 mm or less and the thickness of the partitioning wall is 0.6 mm or less, since the width of the hollow portion of the heat exchanging tube is small and the thickness of the partitioning wall is thin, the heat exchanging efficiency of the heat exchanger can be improved.

In cases where the fin portion is protruded between adjacent partitioning walls in each of the plurality of small hollow portions, the contact between the refrigerant passing through the heat exchanging tube and the fin portion further improves the heat exchanging efficiency. Accordingly, a heat exchanger with higher heat exchanging efficiency can be manufactured.

INDUSTRIAL APPLICABILITY

The extrusion die for manufacturing a tube with a plurality of small hollow portions used for aluminum flat heat exchanging tubes for heat exchangers, the mandrel used for the extrusion die, a multi-hollowed tube manufactured by using the extrusion die, the method for manufacturing a heat exchanging tube, the heat exchanger and the method for manufacturing the heat exchanger, can decrease generation of defects of partitioning wall of the multi-hollowed tube due to insufficient extrusion material and can decrease the width of hollow portion. Furthermore, since breakage of the columnar portion of the extrusion die can be prevented, the extrusion die is preferably used as a die for manufacturing a heat exchanging tube for a heat exchanger.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. An extrusion die for manufacturing a tube with a plurality of small hollow portions arranged in a width direction of the tube, said extrusion die comprising;

a female die for defining an outer periphery of the tube; and a mandrel combined with said female die, wherein said mandrel includes a body portion and a comb-shaped portion protruded from said body portion, said comb-shaped portion including a plurality of columnar portions disposed in a width direction of said comb-shaped portion at certain intervals, wherein an outer periphery of a tip end portion of each of said plurality of columnar portions constitutes a bearing portion for defining an inner periphery of each of the plurality of small hollow portions of the tube, wherein each of said plurality of columnar portions has outside surfaces opposed in a thickness direction of said comb-shaped portion, and at least one of said outside surfaces has an inwardly dented portion behind said bearing portion, said inwardly dented portion constituting an extrusion material filling space, and wherein said at least one of said outside surfaces extending from a basal end portion of each of said plurality of columnar portions to said inwardly dented portion is formed into an inclined or curved surface for leading extrusion material to said inwardly dented portion, and said at least one of said outside surfaces extending from said dented portion to said bearing portion is formed into an inwardly curved surface.

2. The extrusion die for manufacturing a tube with a plurality of small multi hollow portions as recited in claim 1, wherein each of said plurality of columnar portions is provided with a reinforcing rib protruded from a tip end thereof.

3. The extrusion die for manufacturing a tube with a plurality of small multi hollow portions as recited in claim 1, wherein a width of said bearing portion is 2.0 mm or less, and wherein a gap between adjacent bearing portions is 0.6 mm or less.

4. The extrusion die for manufacturing a tube with a plurality of small multi hollow portions as recited in claim 1, wherein each of said plurality of columnar portions is provided with a groove on said at least one of said outside surfaces of said bearing portion.

5. A mandrel to be combined with a female die for regulating an outer periphery of a tube with a plurality of small hollow portions arranged in a width direction of the tube to form an extrusion die for manufacturing the tube, wherein said mandrel includes a body portion and a comb-shaped portion protruded from said body portion, said comb-shaped portion including a plurality of columnar portions disposed in a width direction of said comb-shaped portion at certain intervals, wherein an outer periphery of a tip end portion of each of said plurality of columnar portions constitutes a bearing portion for defining an inner periphery of each of the plurality of small hollow portions of the tube, wherein each of said plurality of columnar portions has outside surfaces opposed in a thickness direction of said comb-shaped portion, and at least one of said outside surfaces has an inwardly dented portion behind said bearing portion, said inwardly dented portion constituting an extrusion material filling space, and wherein said at least one of said outside surfaces extending from a basal end portion of each of said plurality of columnar portions to said inwardly dented portion is formed into an inclined or curved surface for leading extrusion material to said inwardly dented portion, and said at least one of said outside surfaces extending from said dented portion to said bearing portion is formed into an inwardly curved surface.

6. The mandrel as recited in claim 5, wherein each of said plurality of columnar portions is provided with a reinforcing rib protruded from a tip end thereof.

7. The mandrel as recited in claim 5, wherein a width of said bearing portion is 2.0 mm or less, and wherein a gap between adjacent bearing portions is 0.6 mm or less.

8. The mandrel as recited in claim 5, wherein each of said plurality of columnar portions is provided with a groove on said at least one of said outside surfaces of said bearing portion.

9. A method for manufacturing a heat exchanging tube by extruding extrusion material through an extrusion die, wherein said extrusion die comprises:

a female die for defining an outer periphery of the tube; and a mandrel combined with said female die, wherein said mandrel includes a body portion and a comb-shaped portion protruded from said body portion, said comb-shaped portion including a plurality of columnar portions disposed in a width direction of said comb-shaped portion at certain intervals, wherein an outer periphery of a tip end portion of each of said plurality of columnar portions constitutes a bearing portion for defining an inner periphery of each of the plurality of small hollow portions of the tube, wherein each of said plurality of columnar portions has outside surfaces opposed in a thickness direction of said comb-shaped portion, and at least one of said outside surfaces has an inwardly dented portion behind said bearing portion, said inwardly dented portion constituting an extrusion material filling space, and wherein said at least one of said outside surfaces extending from a basal end portion of each of said plurality of columnar portions to said inwardly dented portion is formed into an inclined or curved surface for leading extrusion material to said inwardly dented portion, and said at least one of said outside surfaces extending from said dented portion to said bearing portion is formed into an inwardly curved surface.

10. The method for manufacturing a heat exchanging tube as recited in claim 9, wherein each of said plurality of columnar portions is provided with a reinforcing rib protruded from a tip end thereof.

11. The method for manufacturing a heat exchanging tube as recited in claim 9, wherein a width of said bearing portion is 2.0 mm or less, and wherein a gap between adjacent bearing portions is 0.6 mm or less.

12. The method for manufacturing a heat exchanging tube as recited in claim 9, wherein each of said plurality of columnar portions is provided with a groove on said at least one of said outside surfaces of said bearing portion.

* * * * *